US007798127B2

(12) United States Patent
Notaro et al.

(10) Patent No.: US 7,798,127 B2
(45) Date of Patent: Sep. 21, 2010

(54) TOP MOUNTING FUEL INJECTOR CLIP

(75) Inventors: Cody C. Notaro, Webster, NY (US); Craig L. Smith, Rochester, NY (US); Charles W. Braun, Livonia, NY (US); Jason Urckfitz, Mendon, NY (US)

(73) Assignee: Delphi Technologies, Inc., Troy, MI (US)

( * ) Notice: Subject to any disclaimer, the term of this patent is extended or adjusted under 35 U.S.C. 154(b) by 112 days.

(21) Appl. No.: 12/221,580

(22) Filed: Aug. 5, 2008

(65) Prior Publication Data

US 2010/0031927 A1 Feb. 11, 2010

(51) Int. Cl.
*F02M 61/14* (2006.01)
*F02M 61/18* (2006.01)

(52) U.S. Cl. ..... 123/470; 123/456

(58) Field of Classification Search ..... 123/470, 123/468, 469, 456, 447; 239/600
See application file for complete search history.

(56) References Cited

U.S. PATENT DOCUMENTS 5,035,224 A * 7/1991 Hornby et al. ..... 123/470
5,090,385 A * 2/1992 Usui et al. ..... 123/468
5,136,999 A * 8/1992 Bassler et al. ..... 123/470
5,301,647 A * 4/1994 Lorraine ..... 123/470
5,394,850 A * 3/1995 Murphy et al. ..... 123/470
5,501,195 A 3/1996 Hall
5,520,151 A * 5/1996 Gras et al. ..... 123/470
6,705,292 B2 * 3/2004 Bugos ..... 123/470
6,830,037 B1 12/2004 Braun et al.
7,128,055 B2 * 10/2006 Zdroik ..... 123/470
2002/0139353 A1 * 10/2002 Makiyama ..... 123/470
2004/0237939 A1 * 12/2004 Kondo et al. ..... 123/470
2005/0279328 A1 * 12/2005 Zdroik ..... 123/470

FOREIGN PATENT DOCUMENTS

EP 1978240 10/2008

OTHER PUBLICATIONS

EP Search Report dated Jun. 9, 2010.

* cited by examiner

*Primary Examiner*—Mahmoud Gimie
(74) *Attorney, Agent, or Firm*—Thomas N. Twomey

(57) ABSTRACT

A coupling for suspending a fuel injector from a fuel rail assembly of an internal combustion engine includes a collar that mates with the fuel injector and a retainer clip that engages with the collar thereby mechanically connecting the fuel injector to the fuel rail assembly. The retainer clip includes windows to enable even load distribution upon the socket flange when assembled. Features are integrated in the collar to facilitate correct alignment of the injector relative to the fuel rail. Paired together, the retainer clip and the collar enable a secure, and a keyed fuel injector-to-fuel rail connection that is able to withstand high pressure separating loads.

18 Claims, 4 Drawing Sheets

TOP MOUNTING FUEL INJECTOR CLIP

TECHNICAL FIELD

The present invention relates to fuel injection systems of internal combustion engines; more particularly to fuel rail assemblies for supplying pressurized fuel to fuel injectors for direct injection into engine cylinders; and most particularly, to an apparatus and method for coupling a fuel injector to a fuel rail for direct injection.

BACKGROUND OF THE INVENTION

Fuel rail assemblies for supplying fuel to fuel injectors of internal combustion engines are well known. A fuel rail assembly, also referred to herein simply as a fuel rail, is essentially an elongated tubular fuel manifold connected at an inlet end to a fuel supply system and having a plurality of ports for mating in any of various arrangements with a plurality of fuel injectors to be supplied. Typically, a fuel rail assembly includes a plurality of fuel injector sockets in communication with a manifold supply tube, the injectors being inserted into the sockets.

Fuel injectors may be divided generally into multi-port fuel injectors (MPFI), wherein fuel is injected into a runner of an air intake manifold ahead of a cylinder intake valve, and direct injectors (DI), wherein fuel is injected directly into the combustion chamber of an engine cylinder, typically near the end of the compression stroke of the piston. Since a direct injector is exposed to the pressures within a cylinder, a DI fuel rail assembly must handle significantly higher fuel pressures than a MPFI fuel rail assembly in order to provide precisely metered fuel into a cylinder's combustion chamber.

Because of the higher operating pressures, typically, DI fuel systems employ fuel injectors that are rigidly supported on the engine's cylinder head. The rigid connection between the cylinder head and injector provides enough structural support to withstand the higher operational pressures. However, such a rigid connection has a drawback in that the metal-to-metal contact of the rigid connection provides a direct path for transmitting injector noise. Current MPFI technology includes a hanging injector system that avoids the rigid connection between the cylinder head and the injector by suspending the injectors from the fuel rail via a mechanical coupling. However, while such a coupling solves the noise transmission problem of a rigid connection, the hanging injector connection employed by MPFIs cannot withstand the operating pressures of a DI system.

What is needed in the art is a fuel injector to fuel rail connection that is able to mechanically support loads originating from relatively high fuel pressures and from combustion pressure of direct injection fuel injection systems.

It is a principal object of the present invention to provide a high-pressure fuel injector coupling that easily connects a DI fuel injector to a fuel rail and that is able to manage relatively high separating loads between the fuel rail and the fuel injector due to relatively high DI fuel pressure levels.

SUMMARY OF THE INVENTION

Briefly described, a fuel injector coupling in accordance with the invention includes a retainer clip and a collar, which, when paired together, enable a simple, secure, and keyed fuel injector-to-fuel rail connection that is able to withstand separating loads originating from the relatively high fuel pressure of a direct injection fuel system. Moreover, the coupling provides for a centralized load path along the longitudinal axis of the fuel injector and fuel rail socket.

In one aspect of the invention, the retainer clip is U-shaped to capture an end face of the fuel rail socket and includes diametrically opposed windows for receiving features in a fuel injector collar to positively secure the injector in the socket via the clip and collar. Mating features between the clip and injector collar and between the retaining clip and fuel rail socket rotationally locate the injector to the cup to facilitate correct alignment of the injector relative to its associated combustion chamber in the cylinder head. The retainer clip is shaped to provide ease of assembly and disassembly.

BRIEF DESCRIPTION OF THE DRAWINGS

The present invention will now be described, by way of example, with reference to the accompanying drawings, in which.

Corresponding reference characters indicate corresponding parts throughout the several views. The exemplification set out herein illustrates one preferred embodiment of the invention, in one form, and such exemplification is not to be construed as limiting the scope of the invention in any manner.

DESCRIPTION OF THE PREFERRED EMBODIMENTS

Figure 1A:
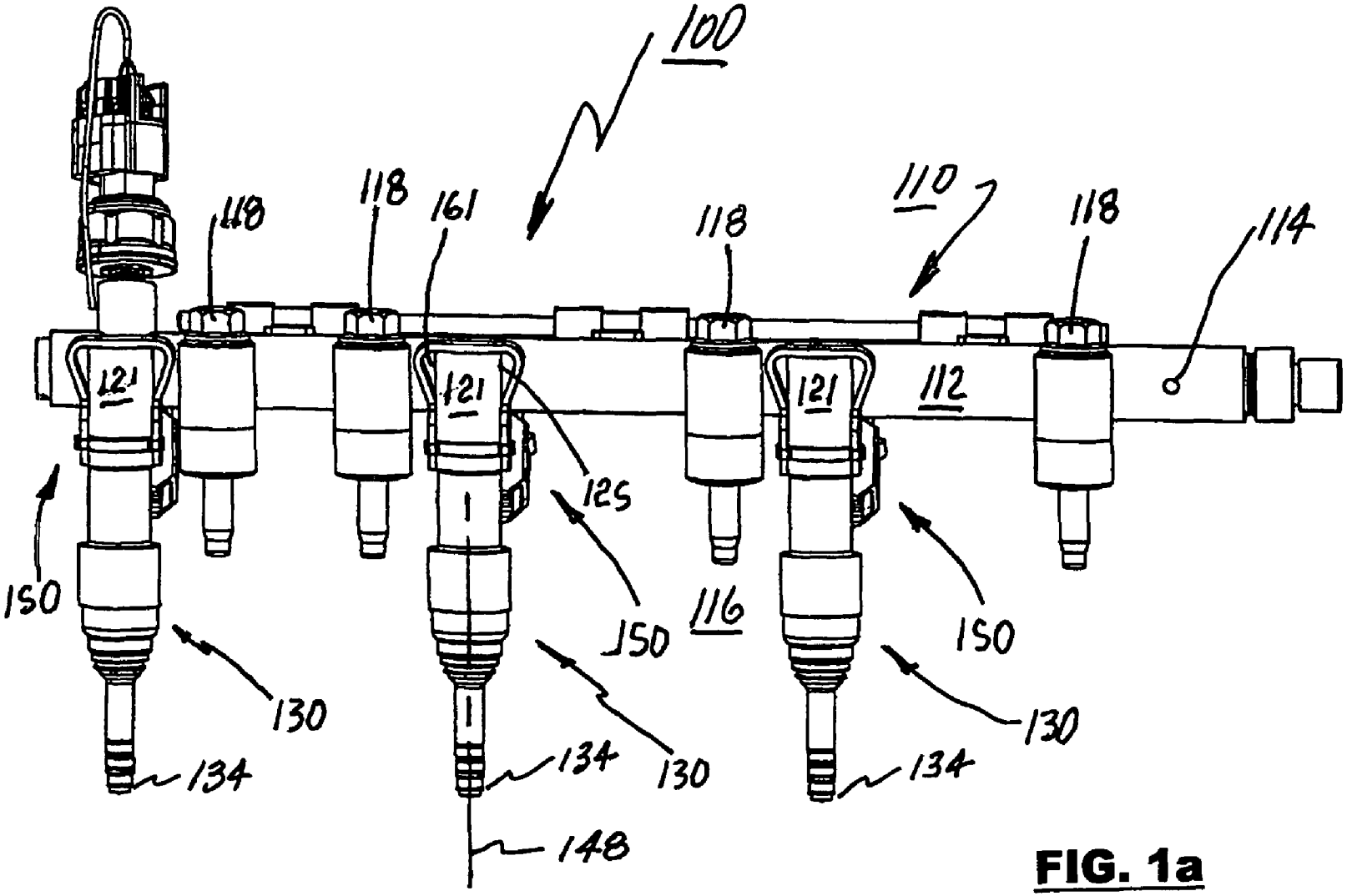
FIG. 1*a* shows a fuel injector/fuel rail system, in accordance with the invention, with one of the injectors and sockets removed.

Referring to FIGS. 1*a*, 1*b*, 2*a* and 2*b*, an injector fuel system 100, in accordance with the invention, includes a fuel rail assembly 110, at least one fuel injector 130 and, for each fuel injector, a coupling 150. Fuel rail assembly 110 includes a fuel distribution conduit 112 that may be, for example, an elongated tube as shown in FIG. 1 or may be a non-round conduit. At least one injector socket 120 is assembled to conduit 112 to be in fluid communication with the interior of conduit 112 via an opening 114, shown in a right-most position on the fuel rail in FIG. 1 before socket 120 is attached to conduit 112. Fuel rail assembly 110 is connected to a typical fuel supply system (not shown). Fuel rail assembly 110 is secured to cylinder head 116 by, for example, bolts 118 such that, through coupling 150, each fuel injector 130 is precisely aligned with its associated cylinder/combustion chamber (not shown).

Injector socket 120 may include a cylindrical body 121 that is closed at one end 122 and that is open at an opposite end 123 for receiving fuel injector 130. Accordingly, injector socket 120 may have, but is not limited to, the shape of a cup as shown in FIG. 1. Injector socket 120 may be straight sided as shown, or may include a flange (not shown) proximate to open end 123. In one aspect of the invention, socket 120 includes a mating feature 126, such as for example, opposing flatted sections 127, disposed substantially 180° from one another, for rotationally positioning the injector relative to the cylinder head, which will be later described.

Fuel injector 130 includes a fuel inlet end 132, a fuel discharge end 134, and an overmold 136 surrounding a fuel tube 138. Fuel tube 138 communicates fuel through the injector from fuel inlet end 132 to discharge end 134. Overmold 136 is positioned such that fuel inlet end 132 of fuel tube 138 extends beyond an upper end 140 of overmold 136 for assembly into injector socket 120. Fuel tube 138 includes a circumferential groove 141, having a width 142, that is positioned adjacent the upper end 140 of overmold 136. In one aspect of the invention, overmold 136 includes anti-rotation feature 144 extending from proximate circumferential groove 141 to beyond an outer surface 139 of overmold 136. The width 145 of anti-rotation feature 144 is approximately equal to twice the radius 146 of the root surface 143 of circumferential groove 142. During manufacture of the injector, anti-rotation feature 144 is indexed to features of the injector, for precisely orienting the injector, rotationally, to the cylinder head. While fuel injector 130 is illustrated as a fuel injector for gasoline direct injection, it may be any other type fuel injector.

Coupling 150 includes a retainer clip 152 and a collar 172. Retainer clip 152 paired with collar 172 enables a positive mechanical retention of fuel injector 130 to socket 120 even under relatively high separating loads. Accordingly, fuel injector 130 is suspended from fuel rail assembly 110 via mechanical coupling 150 such that no hard, metal-to metal contact is necessary between fuel injector 130 and the cylinder head itself to secure the injector to the cylinder head.

Figure 3A:
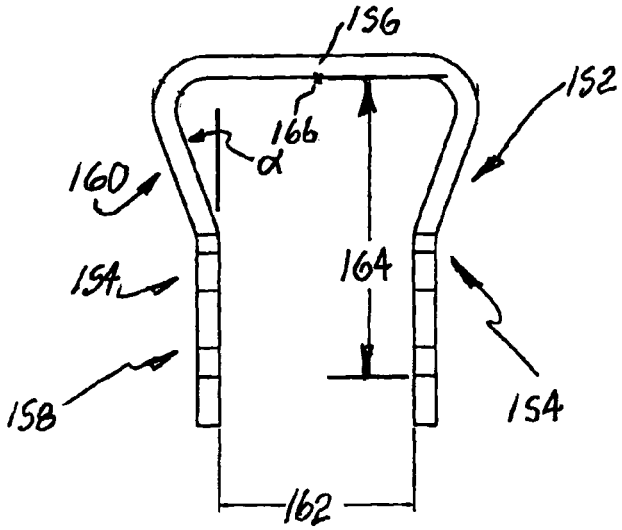
FIGS. 3*a* and 3*b* are views of the retaining clip, in accordance with the invention.
Figure 3B:
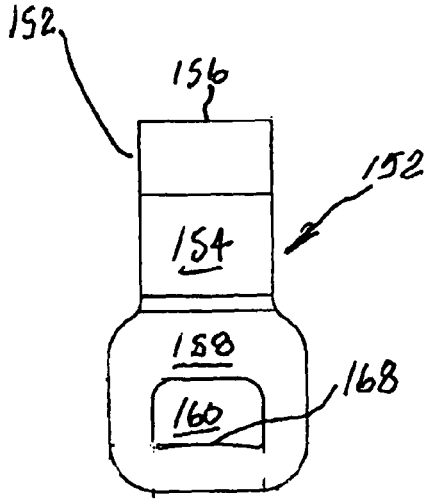

Retainer clip 152 may take a shape generally of a boxed-U having leg portions 154, substantially parallel to each other, and bridge portion 156 joining the leg portions 154 to form the boxed-U shape. Referring to FIGS. 3*a* and 3*b*, leg portions 154 include lower sections 158 and upper sections 160 intermediate the lower sections and bridge portion 156.

In one aspect of the invention, lower sections 158 of retainer clip 152 each include a window 160 sized and positioned for close-fittingly receiving locating features in collar 172 to be described below. Lower edge 168 of each window may include a slight curvature (FIG. 3*b*) for making point contact with the locating features. Lower sections 158 are flat on their inside surfaces to snuggly engage mating features 126 of socket 120, such as flats 127, while, at the same time, bridge portion 156 engages closed end 122 of socket 120, when the clip is assembled to collar 172 and socket 120. Upper sections 160 may depart from the planar surfaces of lower sections 158, on an angle $\alpha$ as shown in FIG. 3*a*, in order to provide clearances 161 (FIG. 1*a*) between the section of socket 120 shown as 125 and clip 152 to assure that the clip is firmly in contact with the socket at flats 127 and closed end 122. Lower sections 158 may include chamfered or outwardly flanged ends (not shown) to facilitate assembly of the clip onto the socket and collar 172. Retainer clip 152 may be formed from sheet spring steel, such as by stamping. In its free state before assembly, width 162 across the lower sections 158 of retainer clip 152 may be slightly less than width 128 across socket flats 127 (FIG. 1*b*). In one aspect of the invention, bridge portion 156 may be slightly concaved (not shown), in the retainer clip's free state.

Figure 4:
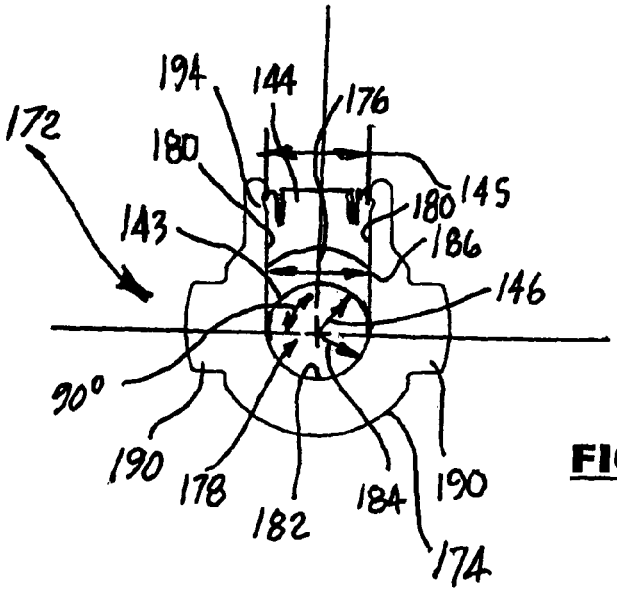
FIG. 4 is a sectioned view of the collar and injector, in accordance with the invention, the sectioned view taken at the top surface of the collar looking down toward the discharge end of the injector.

Referring to FIG. 4, collar 172 is generally circular in shape on its periphery 174. Slot 176 of collar 172 defines central opening 178 having parallel edges 180 and radial inner end 182 for being received in circumferential groove 141 of fuel injector 130. Radius 184 of inner end 182 is equal to or slightly larger than radius 146 of the groove's root surface 143. Width 186 of slot 176 is equal to or slightly larger than width 145 of anti-rotation feature 144. Thickness 188 of collar 172 is slightly less than width 142 of circumferential groove 141. As such, referring to FIG. 2*a*, collar 172 fits snuggly into circumferential groove 141 of the fuel injector. When assembled into the groove, parallel edges 180 abut anti-rotation feature 144 of the injector thereby preventing the collar from rotating about the longitudinal axis 148 of the injector. In one aspect of the invention, one or more collar locating features such as tabs 190 project from periphery 174 and are indexed relative to slot 176 for precisely positioning fuel injector 130 axially and rotationally about its longitudinal axis 148 relative to its associated combustion chamber. In the embodiment shown, tabs 190 are located approximately 90° clockwise and counterclockwise (as shown in FIG. 4) relative to the center of slot 176. Collar 172 may be formed from a non-resilient cold-formable material, such as by stamping, and may be plated for corrosion protection.

Next, a sequence for assembling coupling 150 will be described.

First, collar 172 is inserted into circumferential groove 141 of fuel injector 130 so that parallel edges 180 of slot 176 abut anti-rotation feature 144 and radial inner end 182 of slot 176 fits snuggly against root surface 143 of the circumferential groove. Next, with tabs 190 aligned generally with socket flats 127, the inlet end 132 of injector 130 is inserted into open end 123 of socket 120 until collar 172 abuts the open end 123 of the socket. Finally, retainer clip 152 is slipped over the closed end 122 of socket 120 so that bridge portion 156 of the retainer clip contacts closed end 122 of the socket, lower sections 158 of the retainer clip firmly engage flats 127 of socket 120 and tabs 190 of collar 172 snap into windows 160 of the retainer clip. In one aspect of the invention, before retainer clip 152 is slipped over closed end 122, the distance 164 between point 166 of bridge portion 156 of the retainer clip and edges 168 of windows 160 is slightly less than the dimension measured between the closed end 122 of socket 120 and a lower surface 192 of tabs 190 when collar 172 is abutted against the open end 123 of the socket. As such, when tabs 190 of collar 172 snap into windows 160 of the retainer clip after the retainer clip is in place, injector 130 is held firmly in place in its associated socket to withstand the separating loads originating from the relatively high fuel pressures of a direct injection fuel system. The coupling also provides for a load path centralized by bridge portion 156 and windows 160 of the retainer clip along the longitudinal axis 148 of the fuel injector and fuel rail socket. Moreover, since the injector is precisely positioned axially and rotationally relative to its associated socket via anti-rotation feature 144, tabs 190, windows 160 and flats 127, correct alignment of the injector relative to its associated combustion chamber in the cylinder head is readily maintained.

As shown in FIG. 4, complementary mating features 194 may be incorporated in the collar and in the anti-rotation feature so that the collar may be installed to the injector and held in place by the mating features during injector shipment and prior to assembly of the injector to the fuel rail/engine.

Figure 1B:
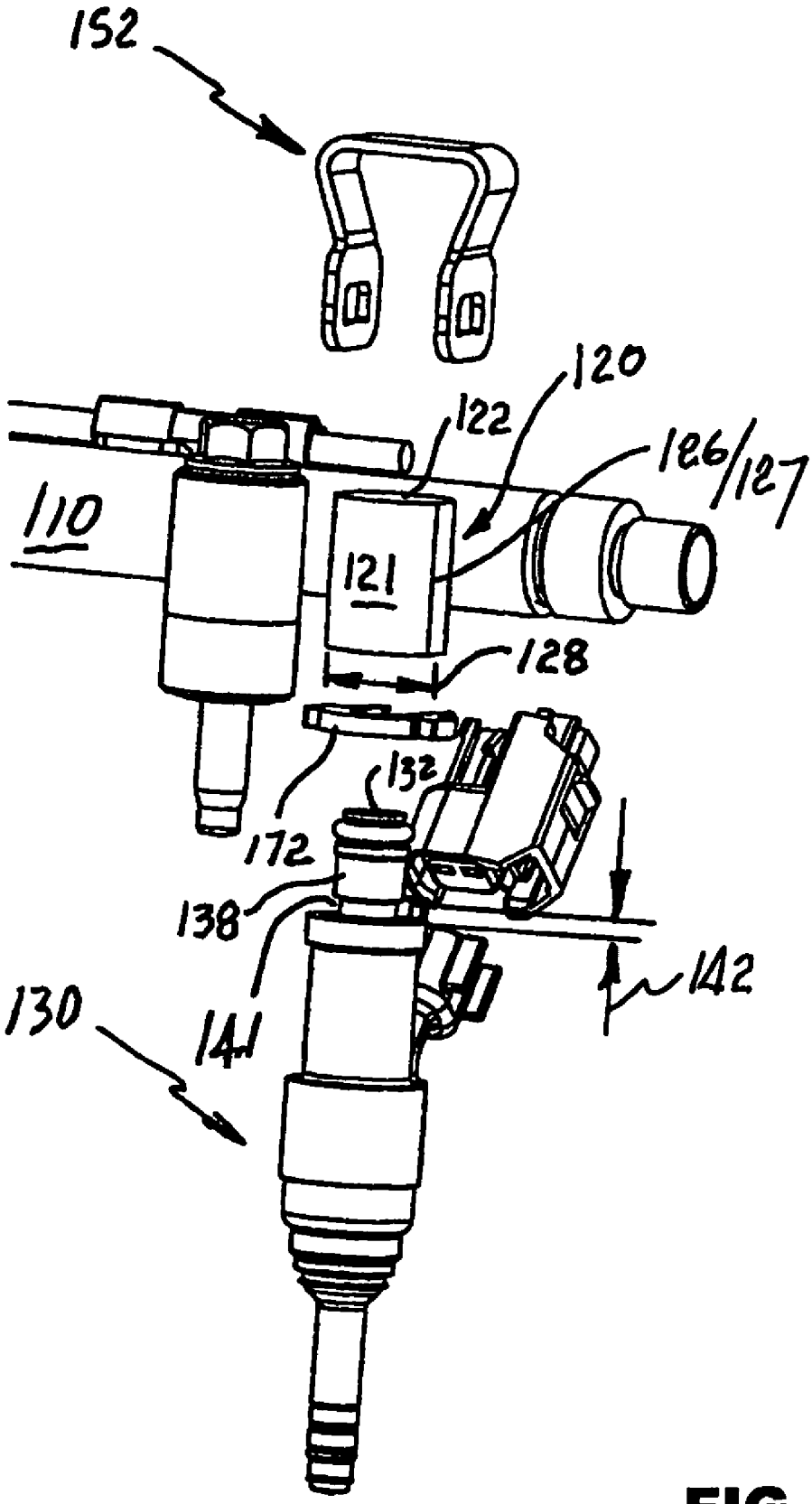
FIG. 1*b* is an isometric exploded view of a section of the fuel injector/fuel rail system shown in FIG. 1*a;*
Figure 2B:
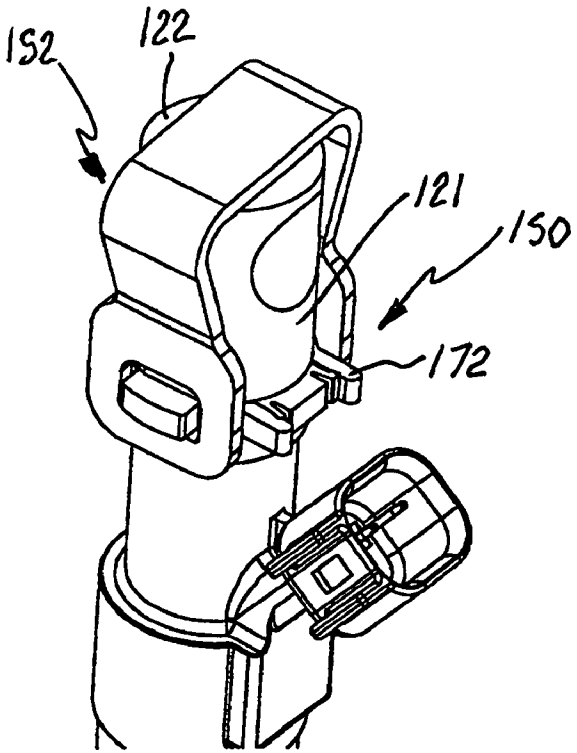
FIG. 2*b* is an isometric view of an assembled coupling, in accordance with the invention.
Figure 2A:
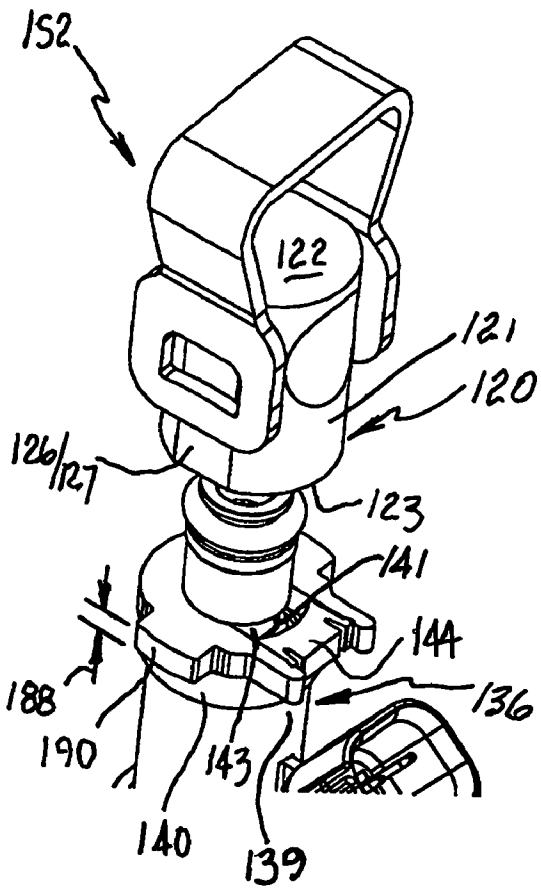
FIG. 2*a* is an isometric exploded view of one injector coupling, in accordance with the invention.

As can be seen in FIG. 1*a*, one coupling 150 is needed per fuel injector 130. Accordingly, coupling 150 may be utilized in an internal combustion engine employing two, four, six, eight, or any other number of cylinders.

While coupling 150 may be especially useful for applications in fuel injection systems for direct injection, applications in fuel injection systems for port injection may be possible.

While the locating feature in the collar and retention clip are shown as tabs and windows, respectively, it is understood that the mating features, in accordance with the invention, are not limited as such.

While the mating feature on the socket is shown as a pair of flats located 180° from each other, it is understood that the mating features can be other types of indexing features and need not be 180° apart and, moreover, can be more or less than two.

While the invention has been described by reference to various specific embodiments, it should be understood that numerous changes may be made within the spirit and scope of the inventive concepts described. Accordingly, it is intended that the invention not be limited to the described embodiments, but will have full scope defined by the language of the following claims.

What is claimed is:

1. A coupling for suspending a fuel injector from a fuel rail assembly of an internal combustion engine, comprising:

a collar including a slot having a feature indexed to said slot, wherein said collar is received within a circumferential groove of said fuel injector and said fuel injector is received within said slot, and wherein said feature assists alignment of said fuel injector to said fuel rail;

a fuel rail socket in fluid communication with said fuel rail, said fuel rail socket having an open end for receiving said fuel injector and a closed end opposite said open end; and a retainer clip including a bridge portion and a leg portion, said leg portion including a window, wherein said bridge portion engages said closed end of said fuel rail socket and said feature of said collar engages said window thereby mechanically connecting said fuel injector to said fuel rail assembly.

2. The coupling of claim 1 wherein said retainer clip has a U-shaped cross-section.

3. The coupling of claim 1 wherein said feature is radially aligned with said slot.

4. The coupling of claim 1, wherein said collar has a generally circular shape, wherein said slot extends into said collar from a circumferential contour of said collar, and wherein said slot is open at said circumferential contour.

5. The coupling of claim 1, wherein said feature extends outwards from a circumferential contour of said collar.

6. The coupling of claim 1, wherein said slot mates with an anti-rotation feature integrated into said fuel injector.

7. The coupling of claim 1, wherein said retainer clip includes a second leg portion, said second leg portion includes a second window, wherein said feature of said collar engages said second window thereby mechanically connecting said fuel injector to said fuel rail assembly.

8. The coupling of claim 1, wherein said window has a curved profile.

9. The coupling of claim 1, wherein said fuel injector is a fuel injector for direct injection of fuel into a cylinder of said internal combustion engine.

10. The coupling of claim 1, wherein said fuel rail socket includes a mating feature and said retaining clip includes a corresponding mating feature for mating with said socket mating feature.

11. The coupling of claim 10, wherein said fuel rail socket mating feature is a flat and said retaining clip corresponding feature is on said leg portion.

12. The coupling of claim 1, wherein said collar is made from a non-resilient cold-formable material.

13. The coupling of claim 1, wherein said retainer clip is removable from said fuel rail socket and said collar.

14. A method for connecting a direct injection fuel injector to a fuel rail assembly, wherein said fuel rail assembly includes at least one cup-shaped fuel rail socket for receiving said injector by an open end, said cup shaped fuel rail socket includes a closed end opposite said open end, the method comprising the steps of:

pre-assembling a collar having a slot into a circumferential groove of said fuel injector, said fuel injector being received within said slot;

inserting said fuel injector with said collar into said open end of said fuel rail socket such that said collar contacts said open end of said fuel rail socket; and mechanically coupling said fuel injector to said fuel rail socket by placing a retainer clip around said closed end of said socket and around said collar.

15. The method of claim 14, further including the steps of:

integrating a keyed feature into said collar;

receiving said keyed feature of said collar with a window integrated into a leg portion of said retainer clip; and indexing said fuel injector relative to said fuel rail assembly.

16. The method of claim 14, further including the steps of:

integrating a mating feature in said injector socket;

forming a corresponding mating feature in said retaining clip; and bringing said injector mating feature in contact with said corresponding retaining clip retaining feature.

17. The method of claim 14, further including the steps of:

forming said collar from a non-resilient cold-formable material.

18. The method of claim 14, wherein said retainer clip is removably placed around said closed end of said socket and said collar.

* * * * *